US005080232A

United States Patent [19]

Leoncavallo et al.

[11] Patent Number: 5,080,232

[45] Date of Patent: Jan. 14, 1992

[54] TEST TUBE RACK AND RETAINER

[75] Inventors: Richard A. Leoncavallo, Pittsford; Gregory R. Phillips, Penfield, both of N.Y.

[73] Assignee: Nalge Company, Rochester, N.Y.

[21] Appl. No.: 703,040

[22] Filed: May 17, 1991

Related U.S. Application Data

[63] Continuation of Ser. No. 507,005, Apr. 10, 1990, abandoned, which is a continuation of Ser. No. 360,121, Jun. 1, 1989, abandoned.

[51] Int. Cl.[5] ..... B65D 85/20; A47B 23/00

[52] U.S. Cl. ..... 206/446; 206/443; 211/74

[58] Field of Search ..... 206/443, 446, 557, 558, 206/560, 565, 562, 563; 211/74; 422/104

[56] References Cited

U.S. PATENT DOCUMENTS

| | | | |
|---|---|---|---|
| 1,869,717 | 8/1932 | Silver | 211/74 X |
| 2,741,913 | 4/1956 | Dovas | 211/74 X |
| 2,917,183 | 12/1959 | Seelye | 211/74 |
| 2,979,210 | 4/1961 | Patterson | 211/74 |
| 3,375,934 | 4/1968 | Bates | 211/74 X |
| 3,474,913 | 10/1969 | Jungner et al. | 211/74 |
| 3,643,812 | 2/1972 | Mander et al. | 206/446 X |
| 3,918,920 | 11/1975 | Barber | 211/74 X |
| 4,124,122 | 11/1978 | Emmitt | 211/74 |
| 4,207,289 | 6/1980 | Weiss | 472/104 |
| 4,273,416 | 6/1981 | Blum | 211/74 X |
| 4,281,768 | 8/1981 | Sommers | 211/74 |
| 4,284,603 | 8/1981 | Korom | 211/74 X |
| 4,389,374 | 6/1983 | Sutton et al. | 422/104 |
| 4,484,907 | 11/1984 | Sheeran et al. | 211/74 X |
| 4,495,150 | 1/1985 | Cook et al. | 422/104 X |
| 4,549,656 | 10/1985 | Barnes et al. | 206/443 X |
| 4,588,095 | 5/1986 | Mehra | 211/74 |

FOREIGN PATENT DOCUMENTS

| | | | |
|---|---|---|---|
| 0022988 | 1/1981 | European Pat. Off. | 211/74 |
| 1514212 | 12/1966 | France | 211/74 |

*Primary Examiner*—Bryon P. Gehman
*Attorney, Agent, or Firm*—Marjama & Pincelli

[57] ABSTRACT

A rack and retainer for use with an existing rack for holding test tubes and similar like articles. The rack or retainer is provided with a projecting member for firmly holding in position a test tube or similar like article placed therein.

13 Claims, 6 Drawing Sheets

TEST TUBE RACK AND RETAINER

This is a continuation of application Ser. No. 07/507,005, filed Apr. 10, 1990, now abandoned, which is a continuation of application Ser. No. 07/360,121, filed June 1, 1989, now abandoned.

The present invention is directed to a rack and retainer for use with an existing rack for securely holding test tubes and other similar like products in a positive manner.

In the prior art, test tubes and other similar like articles are typically placed in a rack having a shelf with a plurality of openings, each opening designed to receive a single test tube or other similar like article. Typically, the opening is sized to receive more than one size test tube. The test tubes freely passed through the openings until the bottom of the test tube hits a bottom support shelf. One of the more common type test tube racks is a plastic rack which has a vertical alignment shelf having a plurality of generally rectangular openings formed in a grid pattern. Because the vertical alignment shelf is designed to provide clearance so as to hold a variety of sizes, the test tubes can easily move within the opening. A problem with such prior art test tube racks is that when moving the rack from a place to another, the test tubes tend to shake and bang against each other, thereby potentially spilling the contents and/or possibly breaking the test tubes. An other problem with such racks is there inability to be used with automatic analytical equipment. Such requires that the test tubes be aligned accurately in a positive manner so that the appropriate ingredients may be accurately inserted into each of the test tubes automatically. Due to the excessive clearance in such prior art racks, they are not suitable for such analytical equipment.

In the prior art there exists test tube rack which provides positive means for holding a plurality of test tubes. These racks typically comprise a plurality of vertically extending side supports which extend from a base support along the side of the tube. The side supports provide a sufficient clearance so as to frictionally engage test tubes placed therebetween. However, these racks are limited for use with a single size tube and because of their construction, the side supports block a substantial portion of the tube so as to severely restrict the viewing of the test tubes placed therein.

Applicants have invented an improved test tube rack and a retainer for use with existing test tube racks which provides positive means for holding of test tubes which is relatively simple in construction and design, allows for variation in test tube size, and is relatively low in cost to manufacture.

SUMMARY OF THE INVENTION

In one aspect of the present invention there is provided a plastic retainer for use with an existing rack having a plurality of openings for holding test tubes or other similar type articles. The plastic retainer is provided with a plurality opening which coincides with the openings in the rack, and an elongated resilient retaining projection integrally formed with the retainer and associated with at least one of the openings in the retainer such that it will firmly hold in position a test tube or other similar like article placed therein. The retainer is also provided with a clasp for securing the retainer to said rack.

In another aspect of the present invention, a rack for holding a plurality of test tubes or other similar type articles is provided. The rack comprising at least one shelf having a plurality of openings designed for allowing placement of a test tube or other similar type article therein. A resilient retaining member integrally formed with the rack is provided and associated with at least one of the openings. The resilient retaining member extends into the opening for firmly holding in position a test tube or other similarly like article placed therein.

DETAILED DESCRIPTION OF THE INVENTION

Figure 1:
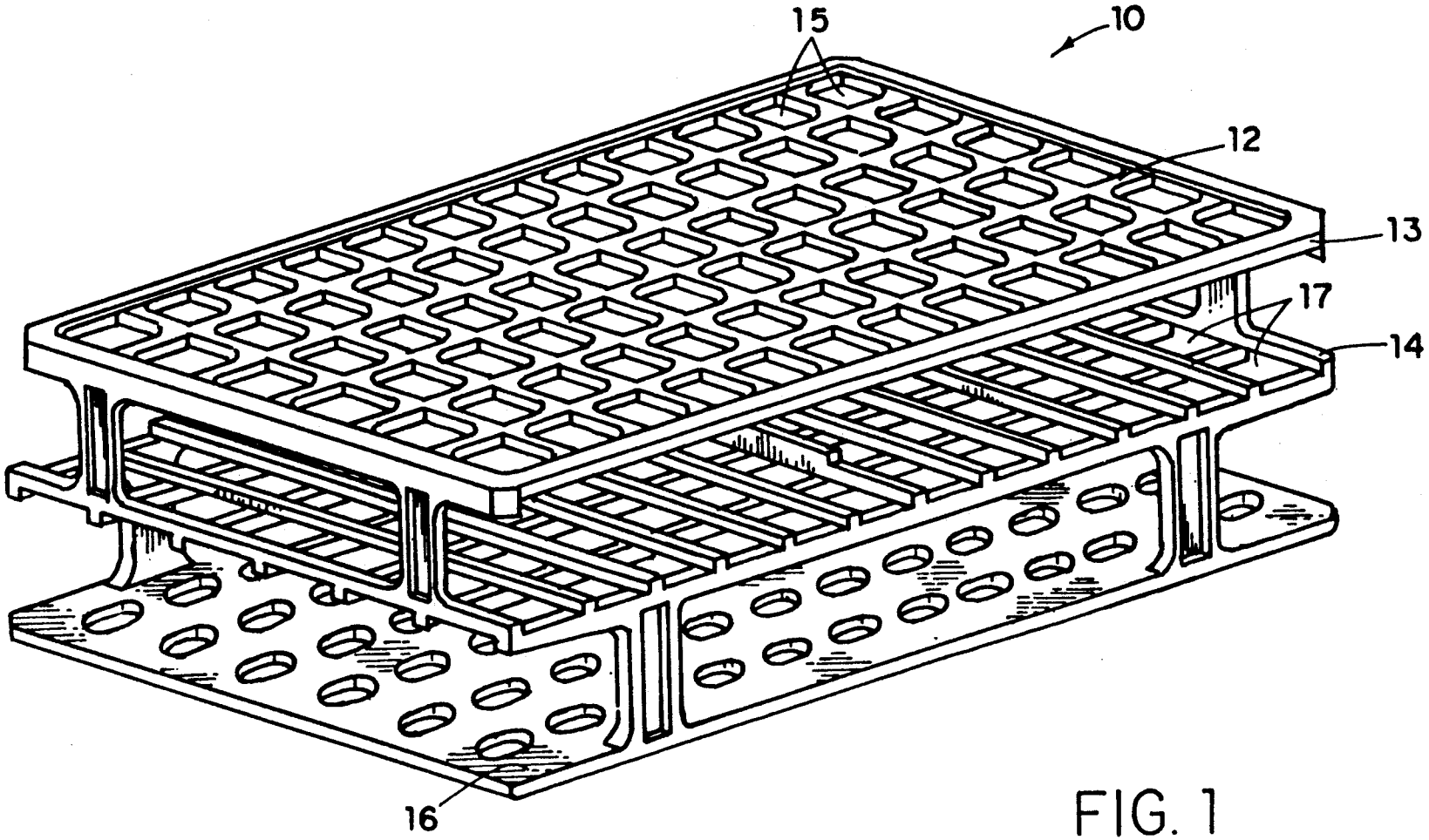
FIG. 1 PRIOR ART
FIG. 1 is a perspective view of a typical plastic test tube rack made in accordance with the prior art.

Referring to FIG. 1, there is illustrated a plastic tube rack, typical of prior art test tube racks. The particular rack illustrated is sold by the Nalge Company under the Unwire trademark. The test tube rack 10 comprises at least one shelf 12, having a plurality of generally rectangular openings 15 formed in a grid pattern. The openings 15 are sized so as to allow test tubes to pass therethrough without touching the side of the openings 15. In the particular embodiment illustrated, the rack 10 includes a second shelf 14 which also comprises a plurality of substantially rectangular openings 17 also formed in a second grid pattern which aligns with the openings 15 of shelf 12. The openings 17 are substantially identical to openings 15. The rack 10 also includes a bottom support shelf 16 which support the bottoms of the test tubes placed through shelves 12 and 14. The openings 15, 17 are sized such that they allow the test tubes to simply pass therethrough, leaving clearance between the outer side surface of the test tubes and sides of opening 15, 17.

Figure 2:
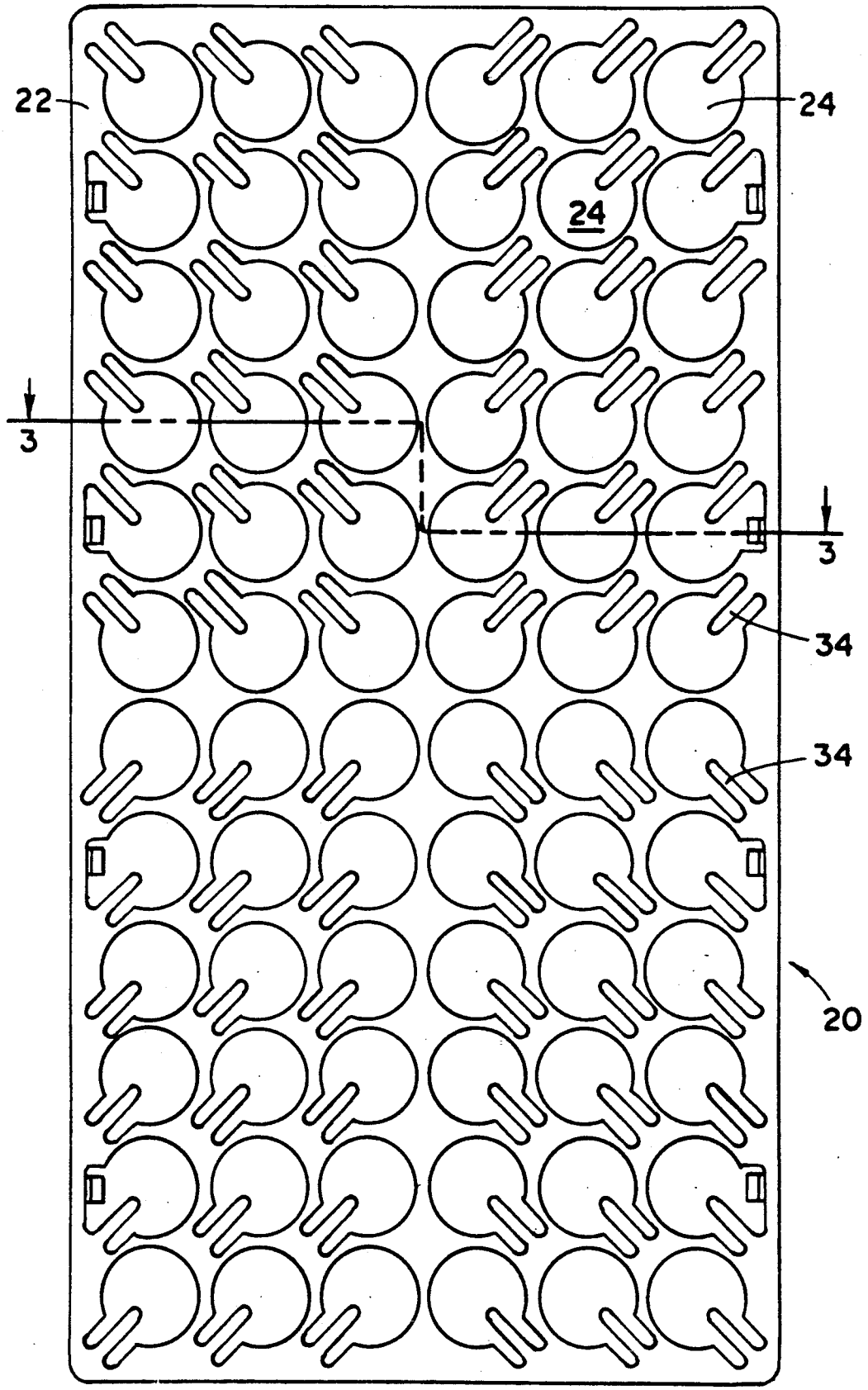
FIG. 2 is a top plan view of a test tube retainer made in accordance with the present invention for use with the test tube rack of FIG. 1.
Figure 3:
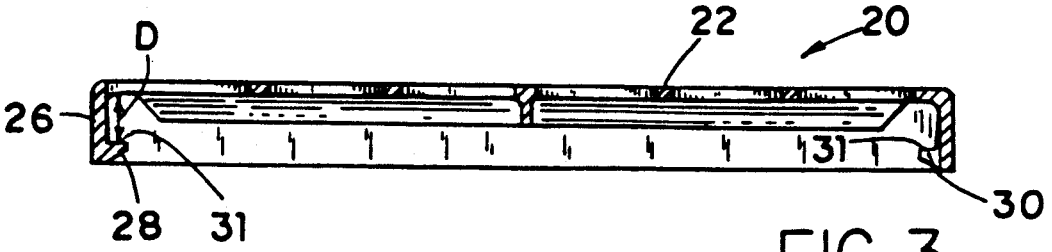
FIG. 3 is a sectional view of the retainer of FIG. 2 taken along line 3—3.
Figure 5:
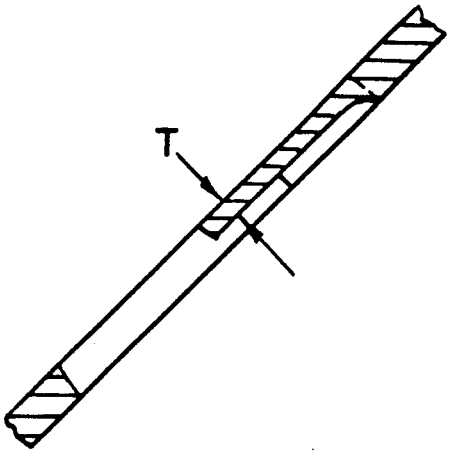
FIG. 5 is a sectional view of the retainer of FIG. 4 taken along line 5—5.
Figure 4:
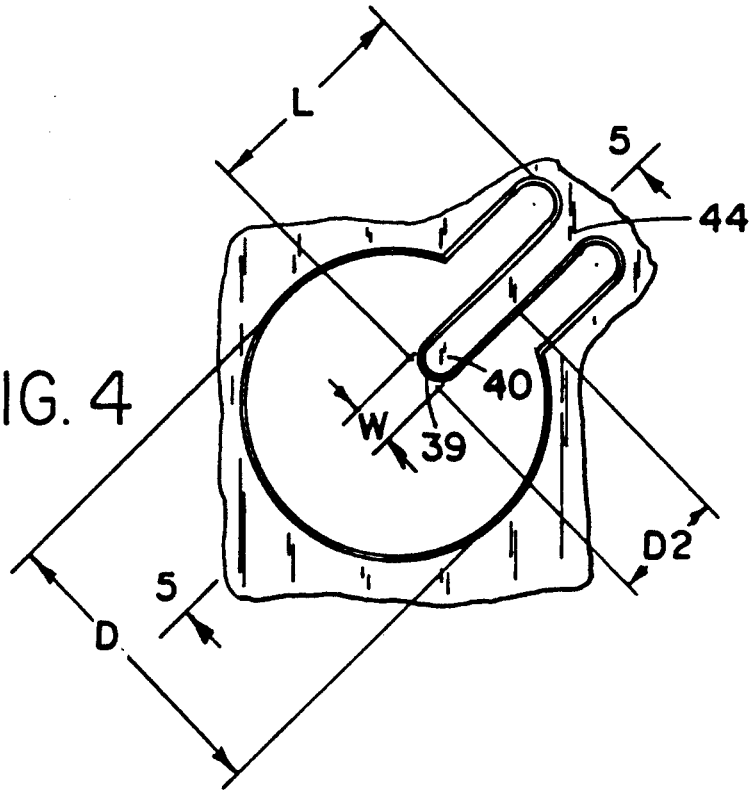
FIG. 4 is an enlarged partial top plan view of the retainer of FIG. 2 illustrating a single opening and the means provided for positively retaining a test tube therein.

Referring to FIGS. 2 and 3, there is illustrated a plastic retainer 20 made in accordance with the present invention designed to be used with the test tubes rack 10 of the prior art. The retainer 20 comprises a support shelf 22 having a plurality of opening 24 placed therein. The openings 24 are spaced so as to align substantially centrally of each of the corresponding openings 15, 17. In particular, embodiment illustrated openings 24 are substantially circular in shape, however, the openings 24 have any other shape so desired. Retainer 20 further comprises an outer retaining side wall 26 extending downward from shelf 22. At the lower end of side wall 26, there is provided a plurality of inwardly extending retaining clip members 28 which are spaced a distance D from the bottom of shelf 22. The retainer 20 is made of a flexible plastic material and is designed such that the retaining clips 28 will fit around the peripheral rim 13 of top shelf 12 of the rack 10 (see FIG. 6). The retainer 20 is made of a compliant flexible plastic so that it can simply snap into position on shelf 12 by appropriately flexing and bending the shelf 22 as it is placed over shelf 12. In the particular embodiment illustrated, rack 10 is made of acetal, however, it is to be understood that retainer 20 may be made of any plastic material desired. In the preferred embodiment, the bottom surface 30 of the retaining clip member 28 is disposed at an angle to allow the rim 13 to easily pass over and inside of retaining clip 28.

Figure 6:
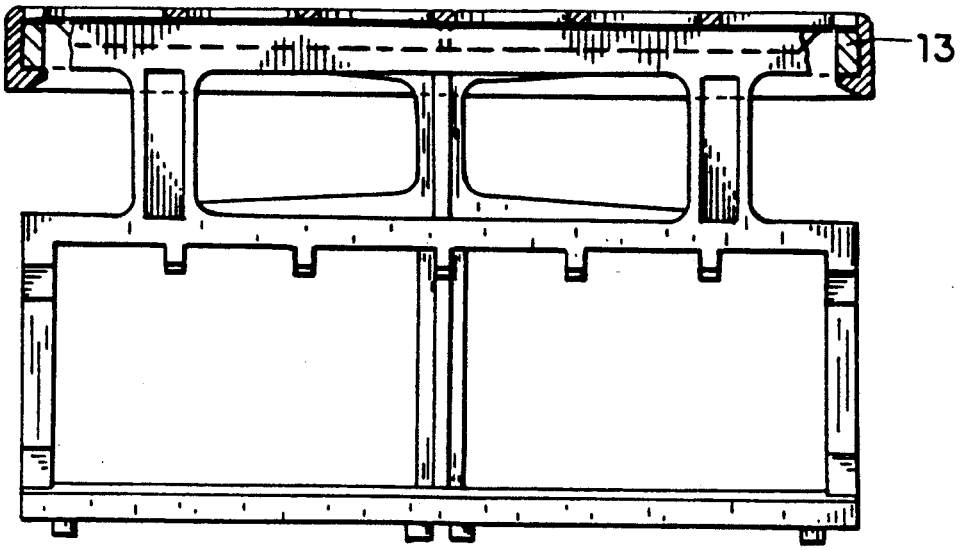
FIG. 6 is a view similar to FIG. 3 with the retainer mounted to the prior art rack of FIG. 1.
Figure 7:
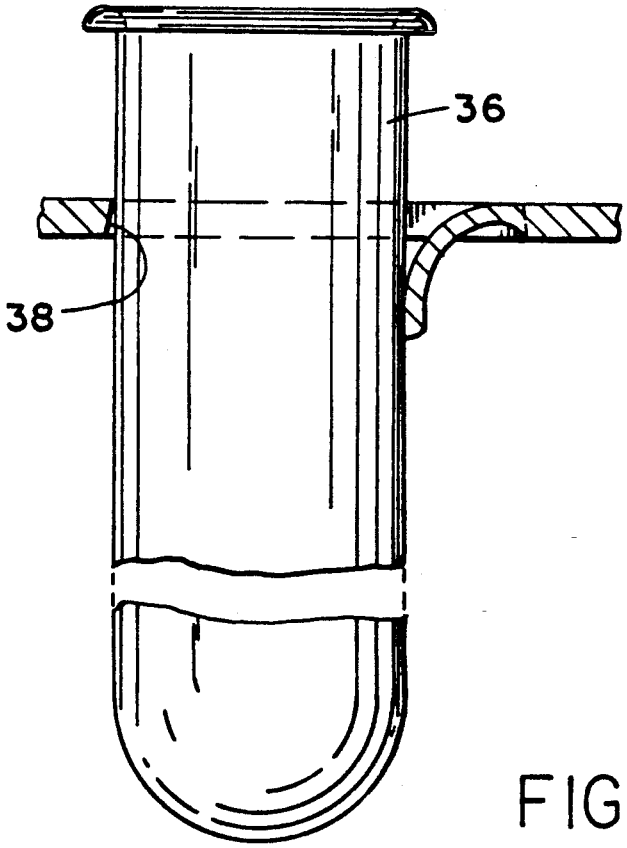
FIG. 7 is a sectional view similar to FIG. 5 illustrating a test tube placed in the opening.

Referring to FIG. 6, there is illustrated a cross-sectional view of the retainer 20 as mounted on to the top shelf 12 of rack 10 illustrating the position of the retaining clip members 28 of retainer 20 as properly mounted to shelf 12. Each retaining clip 28 includes a top engaging surface 31 which engages the outside surface of rim 13 of top shelf 12. In the particular embodiment illustrated, top surface 31 is a substantial planar flat surface. However, it is to be understood that the configuration of top surface 31 and retaining clip member 28 may be varied as desired so long as it provides the appropriate clamping force to hold the retainer 20 in positive engagement with rack 10. Openings 24 are arranged in a pattern which corresponds to the grid pattern of top shelf 12 such that the openings 24 align with a corresponding openings 15 of shelf 12. Associated with each opening 24 and integrally formed with retainer 20 there is provided a flexible elongated retaining member 34 which is directed substantially toward the center of opening 24. The elongated retaining member 34 is designed to flex downwardly as a test tube is passed through opening 32 (see FIG. 7) to its seated position. Thus, the retaining member 34 provides an axial force positively engaging the side of test tube 36 such that the outer surface of the test tube 36 opposite said elongated retaining member 34 engages the inside wall 38 of opening 32. This firmly holds test 36 in position so that it does not move in opening 24. The elongated retaining member 34 has an engaging surface 39 at its outer end 40 which engages the test tube 36. Preferably, as illustrated, the engaging surface 39 has a substantially semicircular outer configuration. However, it is to be understood that the engaging surface 39 may take any other configuration desired. The engaging surface 39 is preferably configurated so as to provide minimal contact surface with the test tube 36 to avoid any undue friction therebetween as the test tube is placed therethrough. In order to provide the degree of flexibility, the elongated retaining member 34 has a length and cross-sectional configuration to allow appropriate deflection. In the particular embodiment illustrated, Applicants have found that an elongated flexible member 34 having a substantially rectangular cross-sectional configuration with a thickness T of about 0.04 inches (1.016 mm), a length L of about 0.5 inches (12.7 mm), and a width W of approximately 0.10 inches (2.54 mm) provides the desired degree of flexibility in the test tube retainer illustrated. However, it is to be understood that the cross-sectional thickness T, width W and length L may be varied according to the degree of flexibility desired. This, of course, is dependent upon the material selection of the retainer. Applicants have also found it very desirable that member 34 have a high degree of flexibility. In order to provide this flexibility, retaining member 34 is made relatively long. In the embodiment illustrated, inner end 44 of member 34 starts at a point outside the generally circular outline of opening 24, thus having a length greater than the distance it extends into opening 24. This provides a high degree of flexibility while also allowing the member 34 to be integrally formed with shelf 22 yet does not extend too far into opening 24. Preferably, as illustrated the outer end 40 of retainer member 34 does not extend a distance D2 into the opening 15 greater than about 40% of the diameter D of opening 15. In the embodiment illustrated, diameter D is about 0.7 inches (17.78 mm), thus outer end extends a distance D2 into opening 24 of about 25 inches (6.35 mm). Since the flexible member 34 is highly flexible, as illustrated in FIG. 7, various test tube sizes may be placed therein in opening 24 while still firmly holding the test tube in position.

It is to be understood that various modifications may be made without departing from the scope of the present invention. FIGS. 8 to 12 illustrate various modified forms which elongated retaining member 34 may take.

Figure 8:
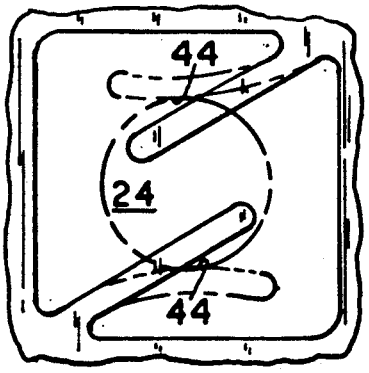
FIGS. 8–12 are enlarged top plan views of various modified embodiments of the means used to positively hold test tubes placed in a retainer made in accordance with the present invention.

Referring to FIG. 8, there is illustrated a greatly enlarged partial top plan view of a retainer 20 illustrated modified means for firmly holding in position a test tube. In this embodiment a pair of elongated members 44 associated with opening 24. Instead of pointing toward the center of the opening 24, elongated members 44 point toward one side such that when a test tube is placed between retaining members 44, the retaining members will be deflected as illustrated by the broken lines, the circular broken line indicating a test tube. The amount of deflection and direction will, of course, vary depending on the outer diameter of the test tube placed therein. However, it can be clearly seen that this type construction can accommodate a variety of different sizes. The particular size and shape of elongating members 44 may be varied so as to provide the degree of flexure desired and amount of retaining force to be placed against test tube placed therethrough.

Figure 9:
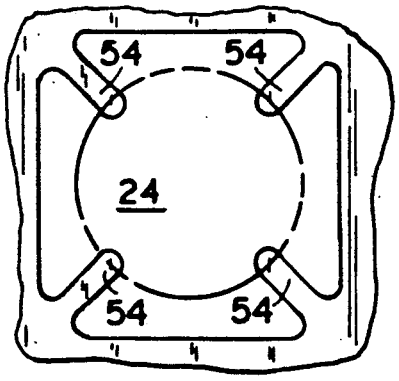

Referring to FIG. 9, there is illustrated yet another embodiment wherein four elongated extending members 54 are spaced substantially equal distant around the outer periphery of each opening 24. The member 54 stops short of coming toward the center and provides a central opening 56 for placement of a test tube therebetween.

Figure 10:
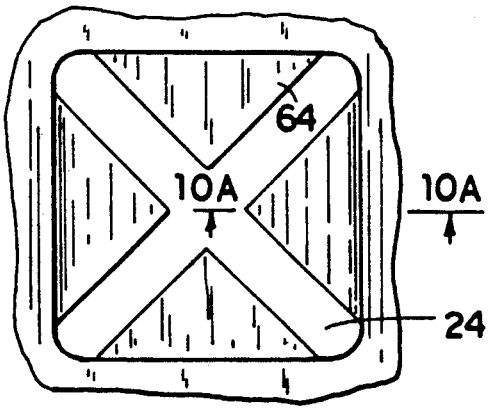
Figure 10A:
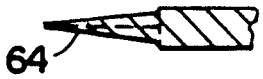

Referring to FIG. 10, there is illustrated another modified form of the present invention wherein there is substantially a triangular member 64, as viewed from the top, and is associated with each opening 24. Referring to FIG. 10A, there is illustrated a cross-sectional view taken along line 10A of FIG. 10. It can be seen in this particular configuration the projections 64 get progressively thinner toward the inner end. A sufficient amount of flexibility is provided to members 64, yet a sufficient amount of force is applied against the outside of the test tube placed therein, so as to firmly hold the test tubes in place.

Figure 11:
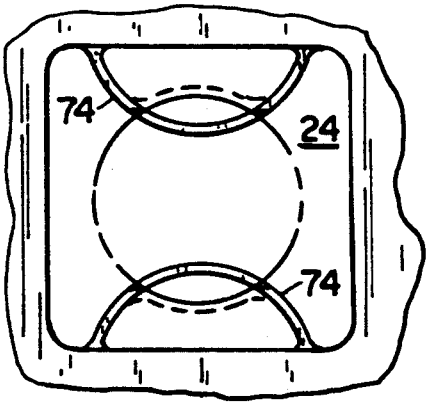

Referring to FIG. 11, there is illustrated yet another embodiment. In this embodiment a pair of semi-hemispherical thin wall projections 74 are provided. The broken lines indicating the deflection of projection 74 in response to a test placed therein (represented by the circular broken line).

Figure 12:
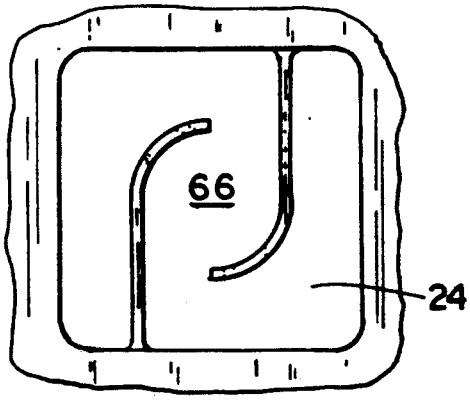

Referring to FIG. 12 there is illustrated a pair of flexible elongated projection 74 which have a hook type configuration which forms a central receiving area 66 wherein a test tube or other similar article can be placed. It can be seen that this type of configuration is quite forgiving with regard to the size Of the test tube that may be placed therebetween.

Figure 13:
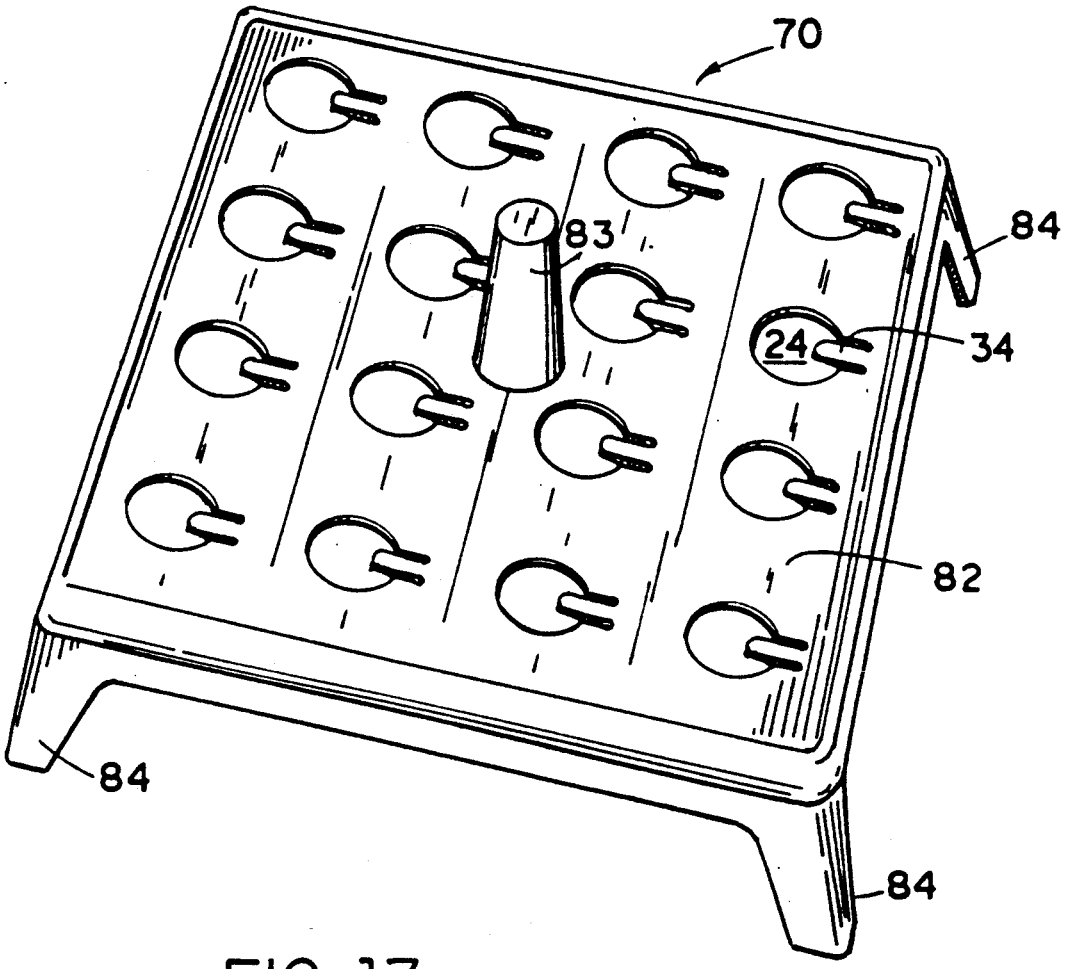
FIG. 13 is a perspective view of a molded rack having means for retaining the test tubes made in accordance with the present invention.

Referring to FIG. 13, there is illustrated a perspective view of a molded plastic rack 70 wherein the top shelf 82 has the retaining 20 integrally formed as a part of the rack 80 instead of a separate attachment thereto, like numerical indicating like parts. The rack 70 includes a plurality of opening 24 each having an elongated member 34 associated therewith and four upstanding support legs 84 integrally formed therewith. This embodiment has the particular advantage in that it can also be placed in a liquid bath. For ease in handling the rack, an upwardly extending handle 83 is provided on the top surface of the rack 70. Typical prior art racks have difficulty in maintaining positive placement of tubes placed therein due to the buoyance of the tubes in the water. In this embodiment, test tubes placed therein would be positively held in position by retaining member 34 such that they don't move around. Since rack 50 can be made of a variety of plastic materials, for example, polypropylene, it can be designed to float upon the surface of the water. Additionally, the elongated members 34 provides means for controlling the height of the test tube within the bath as desired.

It is to be understood that various other modifications can be made within the present invention, the present invention being defined by the following claims.

What is claimed is:

1. An integrally molded plastic retainer for use with an existing rack for holding test tubes, said plastic retainer comprising a support shelf having a plurality of generally circular openings which coincide with said openings in said rack and an elongated resilient flexible retaining member integrally formed with said retainer associated with at least one of said openings in said retainer, said retaining member having an engaging surface and lying in the same plane as said shelf and extending substantially toward the center of said opening such that it is capable of coming in contact and applying a force against various sizes of a test tube placed therein so as to firmly hold said test tube in position, said retaining member having a length which is greater than its extent from the perimeter of said opening to said engaging surface, said retaining member beginning at a point outside the generally circular outline of said opening, said retainer having a means for securing said retainer to said rack.

2. A plastic retainer according to claim 1 wherein said means for securing said retainer to said rack comprises at least one retaining clip designed to engage the top portion of said rack.

3. A plastic retainer according to claim 1 wherein said resilient flexible retaining member having a length of about 0.5 inches, a width of approximately 0.1 inch, and a thickness of approximately 0.04 inches.

4. A plastic retainer according to claim 1 wherein said retainer is made of acetal.

5. A plastic retainer according to claim 1 wherein said resilient retaining member extends into said opening a distance no greater than about 40 percent of the cross-sectional width of said opening.

6. An integrally molded plastic rack for holding a plurality of test tubes, said rack comprising:

at least one shelf having a plurality of generally circular openings designed for allowing placement of a test tube therein; and a resilient highly flexible retaining member integrally formed with said rack associated with at least one of said openings, said resilient highly flexible retaining member having an engaging surface and lying in the same plane as said shelf and extending toward the center of said opening such that it is capable of coming in contact and applying a force against various sizes of a test tube placed said therein so as to firmly hold said test tube in position, said retaining member having a length which is greater than its extent from the perimeter of said opening to said engaging surface said retaining member beginning at a point outside the generally circular outline of said opening.

7. A plastic rack according to claim 6 wherein said elongated retaining member is capable of flexing a sufficient amount so as to allow placement of a test tube within said opening.

8. A plastic rack according to claim 6 wherein support means are provided for supporting said shelf.

9. A plastic rack according to claim 8 wherein said support means comprises four legs.

10. A plastic rack according to claim 6 wherein said rack is made of a plastic material capable of floating.

11. A plastic rack according to claim 6 wherein handle means are provided for gripping said rack.

12. A plastic rack according to claim 11 wherein said handle means comprises an upwardly extending projection extending from the top of said shelf.

13. A plastic rack according to claim 6 wherein said resilient retaining member has a length greater than about 50 percent of the cross-sectional width of said opening, said resilient retaining member extending into said opening a distance no greater than about 40 percent of the cross-sectional width from the edge of said opening.

* * * * *